US009186929B1

(12) United States Patent
Mock

(10) Patent No.: US 9,186,929 B1
(45) Date of Patent: Nov. 17, 2015

(54) ERGONOMIC AND COLLAPSIBLE WRITING INSTRUMENT

(71) Applicant: Craig C. Mock, Dodge City, KS (US)

(72) Inventor: Craig C. Mock, Dodge City, KS (US)

( * ) Notice: Subject to any disclaimer, the term of this patent is extended or adjusted under 35 U.S.C. 154(b) by 0 days.

(21) Appl. No.: 14/587,369

(22) Filed: Dec. 31, 2014

(51) Int. Cl.

| | |
|---|---|
| ***B43K 23/008*** | (2006.01) |
| ***B43K 7/00*** | (2006.01) |
| ***B43K 8/00*** | (2006.01) |
| ***B43K 21/00*** | (2006.01) |

(52) U.S. Cl.
CPC ..... *B43K 23/008* (2013.01); *B43K 7/005* (2013.01); *B43K 8/003* (2013.01); *B43K 21/006* (2013.01)

(58) Field of Classification Search
CPC combination set(s) only.
See application file for complete search history.

(56) References Cited

U.S. PATENT DOCUMENTS

| | | | | |
|---|---|---|---|---|
| 1,367,872 | A | 2/1921 | Glaesser | |
| 1,678,505 | A * | 7/1928 | Gregory | 401/82 |
| 4,508,464 | A | 4/1985 | Money | |
| 4,568,213 | A | 2/1986 | Money | |
| 5,413,428 | A | 5/1995 | Kageyama | |
| 6,464,419 | B1 | 10/2002 | Chan | |
| 8,182,166 | B2 * | 5/2012 | Colman | 401/131 |
| 8,926,203 | B1 * | 1/2015 | Chen | 401/6 |

OTHER PUBLICATIONS

U.S. Appl. No. 14/053,138, Mock, filed Oct. 14, 2013.
U.S. Appl. No. 14/532,924, Mock, filed Nov. 4, 2014.

* cited by examiner

*Primary Examiner* — David Walczak
(74) *Attorney, Agent, or Firm* — Kenneth H. Jack; Davis & Jack, L.L.C.

(57) ABSTRACT

A collapsible writing instrument including a first plate pair consisting of lateral and oppositely lateral plates having upper and lower ends; a first hinge interconnecting the lateral and oppositely plates' lower ends; a second plate pair consisting of an upper lateral plate and lower lateral plate having proximal and distal ends; second hinge interconnecting the lateral plate's upper end and the lower lateral plate's proximal end; a third hinge interconnecting the upper and lower lateral plates' distal ends; a third plate pair consisting of an upper oppositely lateral plate and a lower oppositely lateral plate having proximal and distal ends; a fourth hinge interconnecting the oppositely lateral plate's upper end and the lower oppositely lateral plate's proximal end; a fifth hinge interconnecting the upper and lower lateral plates' distal ends; and a pen cartridge attached to the upper lateral and upper oppositely lateral plates' proximal ends.

7 Claims, 3 Drawing Sheets

ERGONOMIC AND COLLAPSIBLE WRITING INSTRUMENT

The inventor and applicant named in the instant application is the same person as the inventor and applicant named in U.S. patent application Ser. No. 14/053,138 filed Oct. 14, 2013, entitled "Writing Instrument", and is the same person as the inventor and applicant named in U.S. patent application Ser. No. 14/532,924 filed Nov. 4, 2014, entitled "Writing Instrument". Said previously filed patent applications remain pending at the date of filing of the instant application.

FIELD OF THE INVENTION

This invention relates to writing instruments such as pens, markers, and pencils. More particularly, this invention relates to such writing instruments whose body portions are adapted for ergonomic grasping and holding by the fingers of a writer's hand.

BACKGROUND OF THE INVENTION

Pens and pencils having a barrel shaped body or cylindrical body are often grasped between the thumb, index and middle fingers of a writer's hand. During such writing use, the tip of the index finger, the tip of the thumb, and the proximally lateral side of the writer's middle finger are typically placed over contact points arrayed at approximately 120° circumferential intervals about the instrument's cylindrical body. Such common writing instrument holding technique, when applied to a common cylinder bodied pen, often undesirably and unergonomically allows the body of the pen to roll over its points of contact with the writer's fingers, resulting in instability during writing.

The instant inventive writing instrument solves or ameliorates such problems, difficulties, and deficiencies of common barrel body configured pens and pencils described above, by specially configuring the instrument's body to define a plurality of paired hinged plates which pivotably move in flexing and extending motions to assume a T configuration which ergonomically presents finger tip receiving valleys, and to alternatively pivotally extend to a collapsed and compactly storable non-use position.

BRIEF SUMMARY OF THE INVENTION

A first structural component of the instant inventive ergonomic and collapsible writing instrument comprises a first plate pair which cross-sectionally corresponds with the column portion of a capital letter T. In a preferred embodiment, the T column forming first plate pair comprises lateral and oppositely lateral plates composed of plastic, each such plate having an upper end and a lower end. Also in the preferred embodiment, the lateral and oppositely lateral plates are rectangularly configured, and are longitudinally oblongated to a length dimension matching that of a common ballpoint pen or pencil.

A further structural component of the instant inventive writing instrument comprises first pivoting means which are operatively connected to the lateral and oppositely lateral plates' lower ends, and which pivotally or hingedly interconnect those ends. In the preferred embodiment, the first pivot means comprise a hinge selected from the group consisting of plastic living hinges, sleeve and pin hinges (e.g., hinges including a series of interlocking sleeves or eyes which are held in longitudinal alignment by an axially extending hinge pin or axle), and snap lug and snap socket hinges (e.g., lug and socket or detent combinations formed in a longitudinally extending and alternating series along the pivoting joint).

A further structural component of the instant inventive writing instrument comprises a second plate pair which cross-sectionally corresponds with the capital T's lateral cantilevering arm. In the preferred embodiment, such T lateral arm and plate pair comprises an upper lateral plate and a lower lateral plate, each such plate having a proximal end and a distal end, and each such plate co-extending longitudinally with the first plate pair's lateral and oppositely lateral plates.

Further structural components of the instant inventive writing instrument comprise second and third pivoting means which respectively hingedly interconnect the lateral plate's upper end and the lower lateral plate's proximal end and the upper and lower lateral plates' distal ends. In the preferred embodiment, the second and third pivoting means (along with the fourth and fifth pivoting means which are described below) are configured similarly with the first pivoting means.

A further structural component of the instant inventive writing instrument comprises a third plate pair which cross-sectionally corresponds with the oppositely lateral arm which, like the lateral arm, cantilevers from the upper end of the T's column. Similarly with the components of the second plate pair, the third plate pair preferably comprises an upper oppositely lateral plate and a lower oppositely lateral plate, each such plate having proximal and distal ends. In the preferred embodiment, each plate among the third plate pair is longitudinally oblongated for co-extension with each of the writing instrument's other plates.

Further structural components of the instant inventive writing instrument comprise the fourth and fifth pivoting means which respectively hingedly interconnect the oppositely lateral plate's upper end and the lower oppositely lateral plate's proximal end, and the upper and lower oppositely lateral plates' distal ends.

The instant inventive writing instrument preferably further comprises scribing means which are fixedly attached to and are operatively mounted at the upper lateral and oppositely lateral plates' proximal ends. The scribing means preferably comprise a line drawing implement which presents a scribing or surface marking end or tip which extends longitudinally from the longitudinal ends of the first, second, and third plate pairs. The instant inventive instrument's pivoting means are preferably arranged in a manner allowing the first, second, and third plate pairs to pivotally move with respect to each other in alternate flexing and extending motions. Upon plate pair flexions (i.e., angle reducing pivoting motions of paired plates with respect to each other) of the plate pairs, a resultant T cross-section configuration of the writing instrument's body advantageously forms a pair of ergonomic finger tip receiving Vs or valleys. Upon alternate plate pair extensions (i.e., angle increasing pivoting motions of the paired plates with respect to each other) of the first, second, and third plate pairs, the instant inventive writing instrument may advantageously move in a pen body collapsing fashion from the ergonomic T cross-section configuration to a compact and space saving storage configuration.

Accordingly, objects of the instant invention include the provision of an ergonomic and collapsible writing instrument which incorporates structures, as described above, and which arranges those structures in relation to each other in the manners described above for the achievement of objects and benefits described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
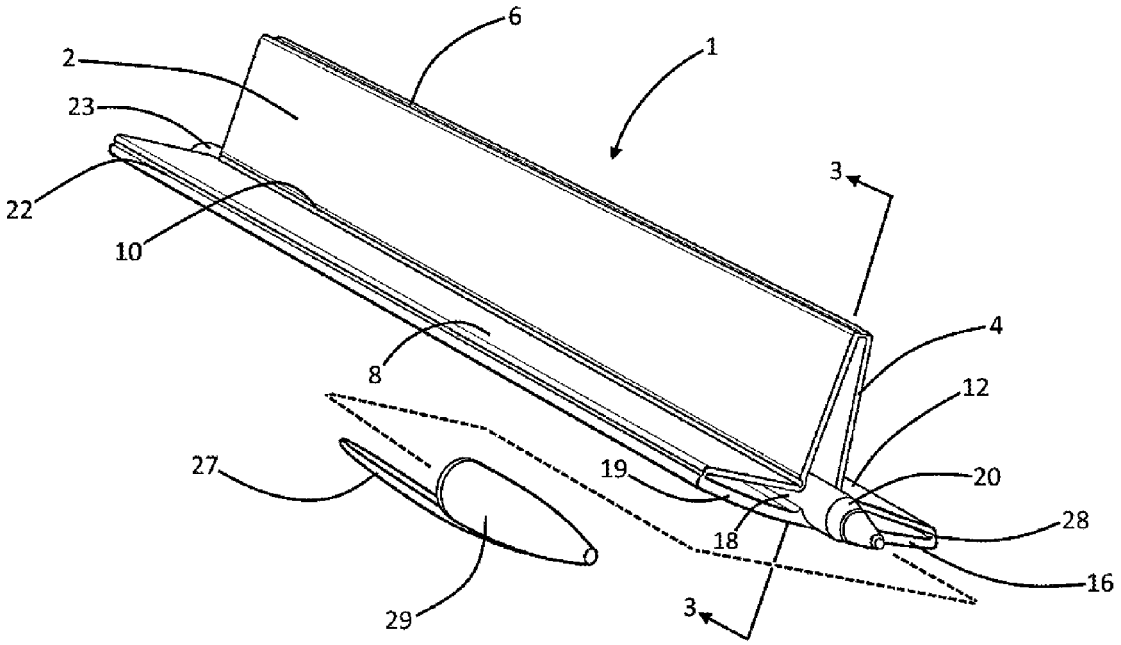
FIG. 1 is a perspective view of a preferred embodiment of the instant inventive ergonomic and collapsible writing instrument.
Figure 3:
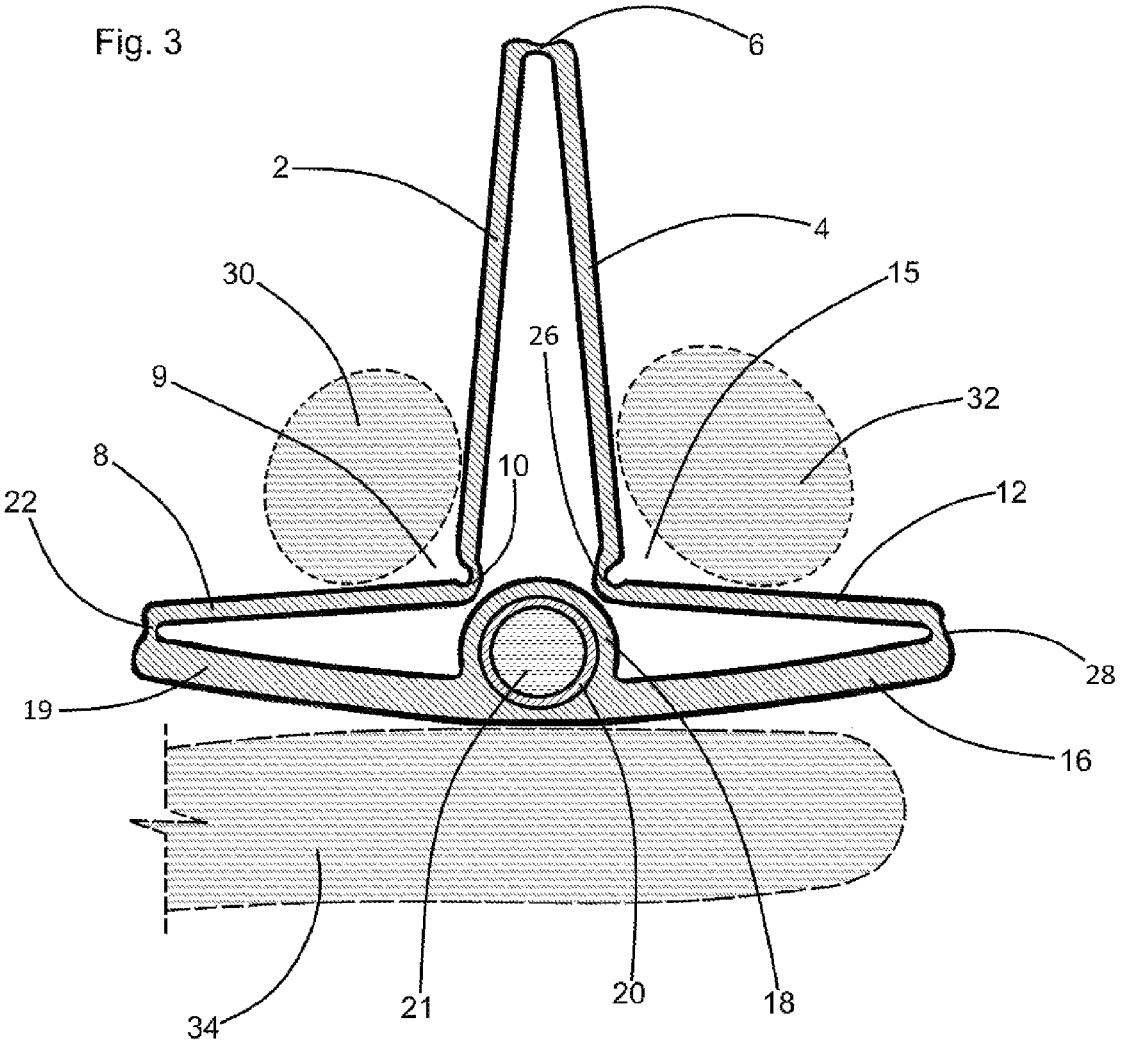
FIG. 3 is a sectional view as indicated in FIG. 1, the view of FIG. 3 representationally showing a writer's fingers grasping the instrument.

Referring now to the drawings and in particular to Drawing FIGS. 1 and 3, a preferred embodiment of the instant inventive ergonomic and collapsible writing instrument is referred to generally by Reference Arrow 1. The lateral cross-sectional profile of the instrument 1 may move to the depicted T configuration wherein the column portion of the T is formed by paired lateral and oppositely lateral plates 2 and 4, wherein the right or lateral arm portion of the T is formed by paired lower lateral and upper lateral plates 8 and 19, and wherein the left or oppositely lateral arm of the T is formed by paired lower oppositely lateral and upper oppositely lateral plates 12 and 16. (According to the views of FIGS. 1 and 3, the lower or base end of the T is oriented upwardly for writing use, and the T's upper arms are oriented downwardly.)

A further structural component of the inventive writing instrument comprises first pivoting means 6 which pivotally and hingedly interconnect the lower ends of the T column's lateral and oppositely lateral plates 2 and 4. In the preferred embodiment, the first pivoting means 6 comprise a hinge selected from the group consisting of plastic living hinges, pin and sleeve hinges, and snap lug and snap socket hinges. While pivoting means 6 is drawn in a fashion most approximating a plastic living hinge, such component is intended as being representative of such other commonly known hinges. Each of the other pivoting means drawn in the drawings (i.e., a second pivoting means hinge 10, a third pivoting means hinge 22, a fourth pivoting means hinge 26, and a fifth pivoting means hinge 28) is preferably configured substantially identically with the first pivoting means hinge 6.

The second pivoting means hinge 10 interconnects the upper end of lateral plate 2 and the proximal end of lower lateral plate 8, and the third pivoting means hinge 22 similarly interconnects the distal ends of the lower lateral plate 8 and the upper lateral plate 19. The fourth pivoting means comprising the hinge 26 preferably interconnects the upper end of the oppositely lateral plate 4 with the proximal end of the lower oppositely lateral plate 12, and the fifth pivoting means comprise hinge 28 which interconnects the distal ends of the upper and lower oppositely lateral plates 16 and 12.

Scribing means are preferably fixedly attached to the proximal ends of the upper lateral and oppositely lateral plates 19 and 16, such means suitably comprising a line drawing implement which comprises a mounting tube or sleeve 18 which is formed wholly with such proximal ends. A tubular ballpoint pen cartridge 20 filled with ink 21 may be slidably and nestingly received within the bore of sleeve 18. Such line drawing implement assembly 18,20,21 is intended as being representative of other commonly known writing and scribing implements such as felt tip markers, felt tip pins, paint pens, mechanical pencils, and touch screen styluses.

In use of the instant inventive writing instrument, the first, second, and third plate pairs consisting of plates 2 and 4, plates 19 and 8, and plates 16 and 12 are capable of alternative manually induced flexing and extending motions. Upon the plate pair flexions, plates 2 and 4, 8 and 19, and 12 and 16, respectively pivot toward each other to approach each other at the acute angles represented in FIG. 3. Upon such flexions of plate pairs, finger tip receiving valleys 9 and 15 respectively bounded by plates 2 and 8, and 4 and 12 are advantageously formed. Such valleys 9 and 15 may securely and ergonomically receive and position the tips 30 and 32 of a writer's index finger and thumb, while the medial lateral aspect of the writer's middle finger 34 engages plates 16 and 19. Accordingly, such flexing pivoting motions of the plate pairs 2 and 4, 8 and 19, and 12 and 16, advantageously configure the instrument 1 in the T cross-section shape of FIGS. 1 and 3 for ergonomic pen body holding and writing.

Figure 2:
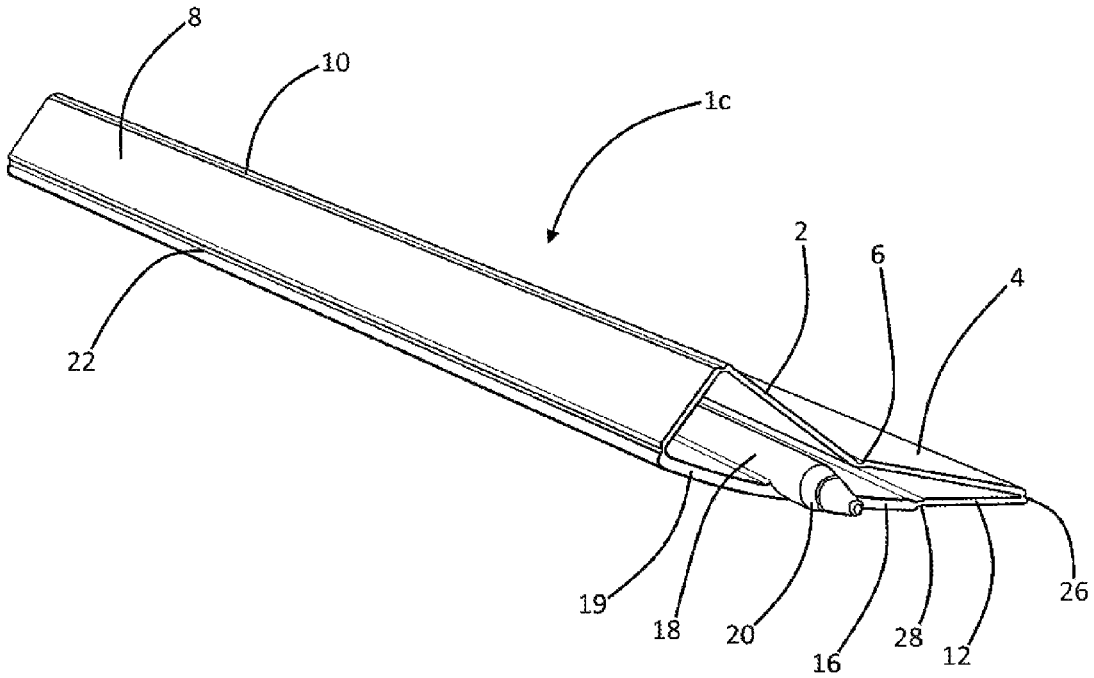
FIG. 2 redepicts the instrument of FIG. 1, the view of FIG. 2 showing the instrument in an alternative collapsed configuration.

Alternatively, referring simultaneously to FIGS. 2 and 3, the plate pairs 2 and 4, 8 and 19, and 12 and 16 may be oppositely manually extended in respective pivoting motions about hinges 6, 22, and 28. Such plate pairs extensions advantageously allow the instrument's plates to pivotally move from the ergonomic T configuration of FIGS. 1 and 3 to the collapsed configuration 1*c* of FIG. 2. In the collapsed FIG. 2 configuration, the writing instrument 1*c* may be compactly and unobtrusively stored within the writer's shirt pocket (not depicted within views).

Referring in particular to FIG. 1, in a preferred embodiment the line drawing implement component 18,20 extends or protrudes longitudinally beyond the longitudinal ends of plates 2, 4,8, 19, 12, and 16, and such components may further include an oppositely longitudinal extension 23. Such longitudinal and oppositely longitudinal extensions advantageously facilitate the provision and use of a pen cap 29 having a pocket clip 27. The cap 29 may cover the longitudinal end of the writing instrument during collapsed storage and non-use. Alternatively, the cap 29 may be stored during writing use by oppositely mounting the cap 29 upon oppositely longitudinal extension 23 during writing use.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

The invention hereby claimed is:

1. An ergonomic and collapsible writing instrument having a longitudinal dimension, said instrument comprising:

(a) a first plate pair comprising lateral and oppositely lateral plates, each plate among the first plate pair having upper and lower ends;

(b) first pivoting means interconnecting the lateral and oppositely lateral plates' lower ends;

(c) a second plate pair comprising an upper lateral plate and lower lateral plate, each plate among the second plate pair having proximal and distal ends;

(d) second pivoting means interconnecting the lateral plate's upper end and the lower lateral plate's proximal end;

(e) third pivoting means interconnecting the upper and lower lateral plates' distal ends;

(f) a third plate pair comprising an upper oppositely lateral plate and a lower oppositely lateral plate, each plate among the third plate pair having proximal and distal ends;

(g) fourth pivoting means interconnecting the oppositely lateral plate's upper end and the lower oppositely lateral plate's proximal end;

(h) fifth pivoting means interconnecting the upper and lower oppositely lateral plates' distal ends; and (i) scribing means fixedly attached to the upper lateral and upper oppositely lateral plates' proximal ends.

2. The ergonomic and collapsible writing instrument of claim 1 wherein the first, second, third, fourth, and fifth pivoting means are adapted for facilitating plate pair flexing and extending movements among the first, second, and third plate pairs; said flexing and extending movements being between a T configuration and a collapsed configuration, the lateral, oppositely lateral, lower lateral, upper lateral, lower oppositely lateral and upper oppositely lateral plates moving toward the T configuration upon the flexions of the first, second, and third plate pairs, and said plates moving toward the collapsed configuration upon the extensions of said plate pairs.

3. The ergonomic and collapsible writing instrument of claim 2 wherein the pivoting means comprise hinges selected from the group consisting of living hinges, pin and sleeve hinges, and snap lug and snap socket hinges.

4. The ergonomic and collapsible writing instrument of claim 3 wherein the scribing means comprise a line drawing implement selected from the group consisting of ballpoint pens, felt-tipped pens, felt-tipped markers, paint pens, touch screen styluses, and mechanical pencils.

5. The ergonomic and collapsible writing instrument of claim 4 wherein each plate among the lateral, oppositely lateral, upper lateral, lower lateral, upper oppositely lateral and lower oppositely lateral plates is composed of plastic.

6. The ergonomic and collapsible writing instrument of claim 5 wherein the proximal ends of the upper lateral and the upper oppositely lateral plates form a longitudinally extending sleeve.

7. The ergonomic and collapsible writing instrument of claim 6 wherein the line drawing implement is nestingly received within the longitudinally extending sleeve.

* * * * *